United States Patent [19]

Baines

[11] Patent Number: 5,022,465

[45] Date of Patent: Jun. 11, 1991

[54] RADIATOR BAFFLE GASKET

[76] Inventor: William F. Baines, 5743 W. Clarendon, Phoenix, Ariz. 85031

[21] Appl. No.: 456,538

[22] Filed: Dec. 26, 1989

[51] Int. Cl.[5] ..... F28F 9/02

[52] U.S. Cl. ..... 165/176; 165/158; 285/137.1; 277/205

[58] Field of Search ..... 165/158, 173, 176, 178; 277/205; 285/137.1

[56] References Cited

U.S. PATENT DOCUMENTS

| | | | |
|---|---|---|---|
| 3,151,674 | 10/1964 | Heller et al. | 165/176 |
| 3,572,429 | 3/1971 | Myers | 165/176 |
| 3,628,603 | 12/1971 | Fieni | 165/176 |

OTHER PUBLICATIONS pp. 14–16, 18–22 and three (3) pages of drawings (unnumbered) from publication titled: "Optimized After Cooling and Low Flow Radiators", ©1985 by Cummins Engine Company, Inc.

*Primary Examiner*—Albert W. Davis, Jr.
*Attorney, Agent, or Firm*—Richard G. Harrer; Charles E. Cates

[57] ABSTRACT

An improved molded gasket for effectively sealing the baffle plate to a radiator core in a multi-pass radiator system. The gasket includes an elongated, generally tubular shaped center section provided with generally flattened end sections. The center section is provided with a slot or groove running the length of the section to receive a free edge and portion of the baffle plate. The end sections are received in the flange area of the tank portion of the radiator.

4 Claims, 1 Drawing Sheet

RADIATOR BAFFLE GASKET

FIELD OF THE INVENTION

This invention relates to engine cooling systems and more particularly to multiple-pass radiators and an improved baffle seal or gasket for use in such radiators.

BACKGROUND OF THE INVENTION

All water cooled engines of either the gasoline or diesel fuel type use a radiator to dissipate the heat adsorbed by the engine jacket coolant. Generally, radiators consist of thin walled tubes, or passages of honeycomb form, through which the coolant is conducted, and across which an air stream is induced, either by the motion of the vehicle if the engine is installed in a vehicle, and/or by a fan. Conventional radiators as used in most automobiles and many trucks are what is called the single pass, vertical flow type or single pass, cross flow type. Thus, the coolant makes a single pass through the radiator core. In the vertical flow type, hot coolant from the engine enters at the top of the radiator and exits at the bottom of the radiator with the coolant temperature having been reduced. In a cross flow radiator, hot coolant from the engine enters at the top of one end of the radiator, flows in a lateral direction through the core, and exits at the bottom of the opposite end of the radiator. Cooling systems which employ the foregoing single pass radiators are usually of the high flow cooling type, that is, the hot coolant from the engine flows rapidly through the radiator resulting in a temperature drop of the coolant of perhaps about 10 degrees F. In some applications, this rather small drop in coolant temperature is not satisfactory for ideal engine performance. As a result, low flow cooling systems have been developed in which the temperature drop across the radiator is significantly greater, about 80 degrees F., resulting in optimum engine performance in certain applications.

Although there are a number of differences between high flow and low flow cooling systems, a basic difference is in the type of radiator employed. As previously mentioned, whereas high flow cooling systems customarily employ a single pass radiator, low flow cooling systems employ so-called multi-pass radiators of various types. A typical two pass, side to side, vertical flow radiator, has a top and bottom tank and radiator core positioned between the two tanks as in a typical single pass vertical flow radiator. However, in the two pass radiator, both the coolant inlet and outlet connections are located either at the top end tank or at the bottom end tank as contrasted with the single pass vertical flow radiator where the coolant inlet connection is usually at the top end tank and the coolant outlet connection is usually at the bottom end tank. In a typical two pass, side-to-side vertical flow radiator, hot coolant enters at one side of the bottom end tank, flows upwardly through one half of the radiator core to the top end tank, and the proceeds in a downward direction through the other half of the radiator core to the bottom end tank and then exits from the bottom end tank back to the engine. In all multi-pass radiators, it is necessary to employ a baffle plate to effectively divide the radiator core. Thus, in the two-pass, side-to-side vertical-flow radiator just described, a baffle plate is located in the bottom end tank and effectively divides the tank into two tanks. This construction directs coolant flow up the core in one half the tubes of the core and down the core in the other one half of the tubes. There are other types of multi-pass radiators available. For example, there is a so-called three-pass, side-to-side, vertical flow radiator with a baffle in both the top and bottom end tanks. The coolant inlet and one baffle plate are located in the top end tank and the coolant outlet and an additional baffle are located in the bottom end tank. Thus the coolant makes three vertical passes in its flow through this type of radiator. There are also multi-pass cross flow radiators which cause the coolant to make several passes through the radiator core. However, no matter which particular type of multi-pass radiator is used for cooling, baffle plates are employed to separate inlet and outlet coolant flows.

It is important in multi-pass radiators that the separation of inlet and outlet coolant flows be as complete as possible. For example, it has been determined that a leak equivalent to a one-eighth inch hole between the inlet and outlet flows could decrease radiator performance substantially and be a source of overheating problems. Thus, a number of different techniques have been employed to seal the tank end baffles. Some radiator baffle plates are sealed at the radiator core with a flat gasket, the gasket being attached to the core header plate with what is called a "RTV" sealant. RTV sealants are typically described as high temperature gasket forming compounds employing silicones. A seal is made as the baffle compresses the gasket when the end tank is installed to the radiator core. In the construction of most multi-pass radiators, the baffle plate is sealed at the radiator core by inserting the free edge of the baffle plate into an elongated channel which is soldered or welded to the radiator core header plate. Such channel is usually V-shaped (called a "V-clip") or U-shaped. Prior to inserting the baffle plate into the V-clip, the clip is filled with an RTV sealant and then the baffle plate is inserted into the clip resulting in a seal along the entire length of the baffle plate. RTV sealant is also applied to a small area in the interior of the tank where the top end of the plate meets the radiator casing flange and tank flange. In a still different construction, the baffle plate is sealed to the radiator core by means of a thick, slotted gasket. Again, RTV sealant is used to hold the gasket in place and seal the baffle in the slot in the gasket. However, most multi-pass radiators designs use the baffle plate welded to the tank and a V-groove or "clip" welded to the header. The clip retains a bead of RTV sealant that provides the seal. As noted earlier, RTV sealant is also applied to a small area in the tank interior where the top end of the baffle plate meets the juncture of the radiator casing flange and tank flange.

In repairing multi-pass radiators, it is usually necessary that the end tanks be removed from the core and such removal of course destroys the seals formed by the RTV sealant. When the radiator core and end tanks are reassembled, it is of course necessary that the baffle plate be resealed as previously described. However, before reassembling the components of the radiator, it is extremely important that both the baffle plate and the clip be thoroughly cleaned in the area where the RTV sealant is to be applied. The surfaces must be wire brushed or cleaned with steel wool, followed by a solvent wash and then all parts are thoroughly dried before applying the RTV sealant. It is also important that excessive amounts of RTV sealant not be used since this could result in portions of the sealant breaking away and resulting in plugged coolant passages, particularly the radiator tubes. Moreover, after assembly of the sections using the RTV sealant, the sealant must cure for 8-10 hours or, curing can be speeded up by applying moderate heat (about 250 degrees F.) for a period of perhaps thirty minutes to one hour. It is thus seen that proper baffle sealing is critical to good engine cooling performance. It has also been seen that repairing a radiator which necessitates resealing these critical areas is a time consuming operation and must be performed in a skilled manner, otherwise leakage will certainly occur. Thus, there are a number of disadvantages to the current techniques employed in sealing baffle plates in multi-pass radiators.

Accordingly, it is a principal object of this invention to provide an improved baffle plate seal in multi-pass radiators.

It is a further object of this invention to provide an improved baffle plate seal in multi-pass radiators that eliminates the need for RTV sealants.

It is a still further object of this invention to provide an improved baffle seal in multi-pass radiators which will provide a leak-free connection between the V-clip and the baffle, as well as the void where the top end of the baffle plate meets the radiator casing flange and tank flange.

It is a still further object of this invention to provide a formed gasket of special construction which will provide an improved baffle plate seal in multi-pass radiators, the formed gasket providing a leak-free connection not only between the clip and baffle, but in the void where the top end of the baffle plate meets the radiator casing flange and tank flange.

These and other objects of the invention will be apparent from the following description and claims.

STATEMENT OF THE INVENTION

Based on the prior art methods for sealing baffle plates in multi-pass radiators, there then exists a need for an improved seal for end tank baffle plates which not only provides an effective seal, but effectively eliminates the need for RTV sealants, and seals the baffle plate to the radiator core while at the same time sealing the void or area where the top end of the baffle plate meets the flanges of the radiator casing and tank.

Accordingly, I have invented a molded or formed seal or gasket which effectively eliminates the need for RTV sealants for end tank baffle plates, is easy to install, requires no curing period and very effectively seals the baffle plate to the radiator core and the area between the upper end of the baffle plate and the juncture of the radiator casing flange and tank flange. The gasket of this invention has an elongated center section with flattened sections at each end of the center section. An elongated open groove runs the length of the center section to receive one edge of the baffle plate. In a preferred embodiment, the gasket has a hollow, tubular center section with a slot or groove running the length of the center section, and the entire gasket is made of neoprene synthetic rubber or equivalent.

DETAILED DESCRIPTION OF THE INVENTION

Figure 1:
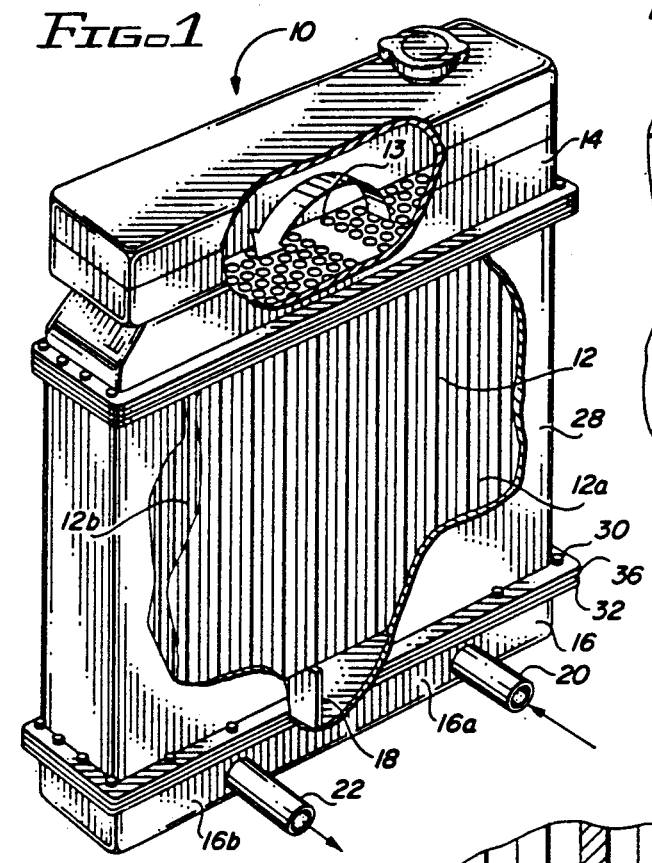
FIG. 1 is a perspective view of a two-pass, side-by-side vertical flow radiator.
Figure 2:
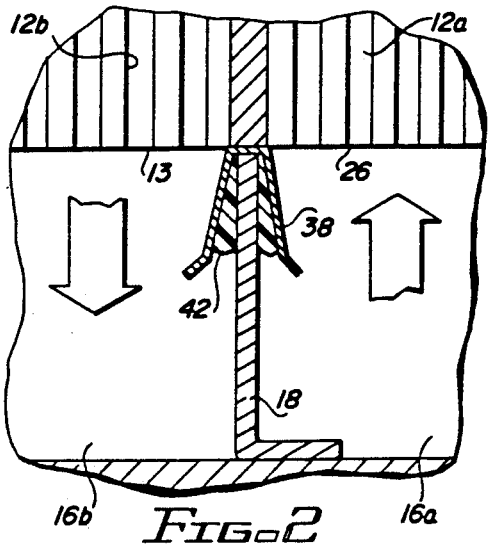
FIG. 2 is a part sectional view showing the prior art technique of sealing a baffle plate.
Figure 3:
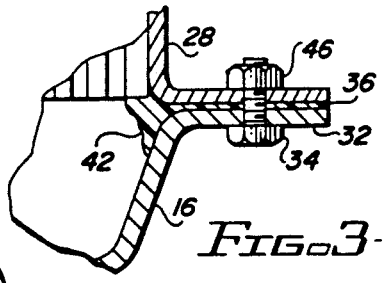
FIG. 3 is a part sectional view showing the prior art technique of sealing the area between the upper end of the baffle plate and the juncture of the radiator casing flange and tank flange.
Figure 7:
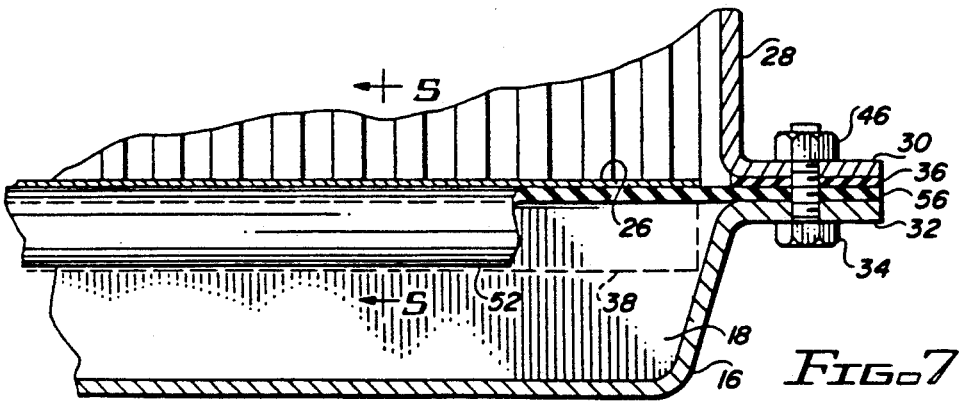
FIG. 7 is a part side sectional view showing the special gasket of this invention positioned in a V-clip and sealing the one edge of the baffle plate and also showing that the special gasket also seals the area between the upper end of the baffle plate and the juncture of the radiator casing flange and tank flange.

Considering now the drawings in detail, FIG. 1 is a perspective view of a typical multi-pass side-by-side vertical flow radiator employing a baffle plate and the particular radiator shown is a two-pass system. As shown, radiator 10 is provided with a core 12 made up of a series of hollow tubes 13, a top tank 14, bottom tank 16 and radiator casing 28. Radiator casing 28 is provided with flange 30 and bottom tank 16 is provided with flange 32. Thus, the bottom tank is secured to the radiator casing by means of the aforesaid flanges with a perimeter gasket 36 between the flanges. It will be seen that there is a series of bolts 34 and nuts 46 which secure the bottom tank to the radiator casing. In this typical two-pass radiator, a baffle plate 18 effectively divides the the lower tank into tank sections **16*a* and 16*b*. The baffle plate 18 also serves to effectively divide the core 12 into side-by-side sections 12*a* and 12*b*. Thus, for optimum cooling, there should be no mixing of coolant between core sections 12*a* and 12*b* nor in lower tank sections 16*a* and 16*b*. Bottom tank 16 is also provided with coolant inlet pipe 20 and coolant outlet pipe 22. Hot coolant from the engine enters inlet pipe 20 into bottom tank section 16*a* and then flows in an upward direction through core section 12*a* and into upper tank 14. The coolant thereafter flows downwardly through hollow tubes 13 in core section 12*b* to section 16*b* of the lower tank and then through coolant outlet pipe 22. As previously noted, it is very important in multi-pass radiators that the separation of inlet and outlet coolant flows be complete as possible. Although not shown in FIG. 1, all multi-pass radiator designs use a baffle plate welded to the interior of the bottom or top tank, and a V-groove or "clip" soldered to the header plate. This well known construction is shown in FIG. 2 where V-clip 38 is shown soldered to core header plate 26. Baffle plate 18 is welded to the bottom and side walls of bottom tank 16 as shown in FIG. 7. In this type of construction, V-clip 38 is filled with an appropriate RTV sealant 42 and thereafter the free edge of baffle plate 18 is forced into the clip as shown in FIG. 2. The RTV sealant 42 surrounds the baffle plate 18 in the V-clip to provide a seal between the adjacent sections 16*a* and 16*b* of the bottom tank 16. Although each of the two ends of the baffle plate fit up tightly against the side walls of the bottom tank, there is a small area in the interior of the bottom tank where the flange of the bottom tank and the flange of the radiator casing join which should also be sealed. As shown in FIG. 3, a small amount of RTV sealant 42** is also applied to this area.

Figure 4:
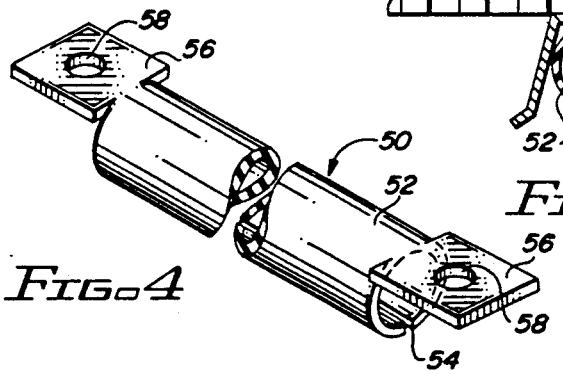
FIG. 4 is a perspective view of the special gasket of this invention.

FIG. 4 is a perspective view of the improved gasket or seal of this invention. As shown, the molded or formed gasket comprises an elongated tubular center section 52 and flattened end sections 56 integral with the center section. In a preferred embodiment, the interior of section 52 is hollow. An elongated groove or slot 54 runs the entire length of center section 52 and is open to the interior of center section 52. Each of end sections 56 is optionally provided with an opening 58 which provides for passage of bolts 34 when fastening bottom tank 16 to radiator casing 28. It is preferred that gasket 50 be made of a material which is deformable, somewhat flexible and resistant to the temperatures and chemicals employed in radiator coolants. Neoprene synthetic rubber, nitrile rubbers and silicone rubbers work well.

Figure 5:
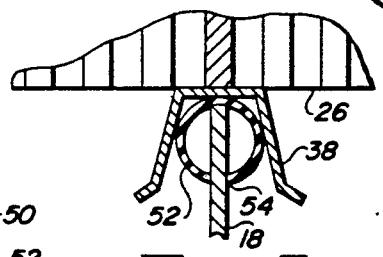
FIG. 5 is a part end sectional view taken on the line 5—5 of FIG. 7 showing the special gasket of this invention sealing an edge of a baffle plate in a so-called V-clip.
Figure 6:
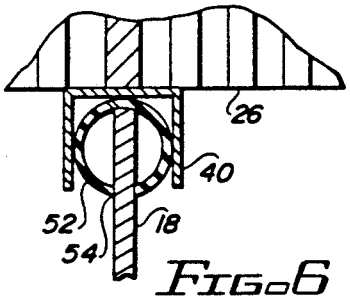
FIG. 6 is a part end sectional view showing the special gasket of this invention sealing an edge of a baffle plate in a so-called U-clip.

FIGS. 5–7 show the use and installation of the special gasket 50 in a V-clip 38 or U-clip 40. As previously described, clips 38 or 40 are soldered to the radiator header plate 26 and receive the free edge and a portion of the baffle plate 18. Prior to assembly of bottom tank 16 and its baffle plate 18 to the radiator, gasket 50 is installed on the baffle plate by inserting the free edge of the baffle plate through slot 54 in a manner such that tubular section 52 fits snuggly down on and around the upper portion of the baffle plate as shown in FIGS. 5 and 6. After the center section 52 has been properly positioned on the baffle plate, ends 56 of gasket 50 are extended over the upper side of flange 32 of bottom tank 16 as shown in FIG. 7. Ends 56 of gasket 50 are optionally provided with opening 58 to accommodate bolt 34 if the baffle plate is aligned with a bolt and nut assembly in the flange area of the radiator casing and bottom tank. Thereafter, flange gasket 36 which is employed about the perimeter of the flange area is layed over the flange and over end sections 56 and the bottom tank is ready to be assembled to the radiator. During the assembly process, a portion of baffle plate 18 and center section 52 of gasket 50 is forced into the V-clip as shown in FIG. 5 or the U-clip as shown in FIG. 6 and thus provides an effective seal between the upper edge of the baffle plate and header plate 26. It is advisable to coat the center section 52 of the gasket with a lubricant such as liquid soap or liquid synthetic detergent prior to forcing the gasket into the clip. Moreover, as shown best in FIG. 7, end sections 56 also provide an effective seal in the area between the top of the end of the baffle plate 18 and the flange area. Thus there is no need to place an RTV sealant in this area as shown in FIG. 3. The dimensions of the center section 52 and end sections 56 of gasket 50 will of course vary depending on the particular radiator assembly. Center section 52 should be of the same length of the leading or free edge of the baffle plate and of a diameter such that after the baffle plate and gasket are inserted into the clip, the center section of the gasket makes good contact with the interior walls of the clip, preferably deformed to a degree. End sections 56 should be of a length such that the ends adequately cover the width of the flange area between the radiator casing and bottom tank.

Although the foregoing description has been detailed with respect to a typical two-pass, side-by-side vertical flow radiator, as previously noted, there are other types. of multi-pass radiators which employ baffle plates. Thus there is a so-called three-pass, side-to-side, vertical flow radiator with a baffle plate in both the top and bottom end tanks. Also, there are multi-pass cross flow radiators and again, baffle plates are employed to properly direct the coolant flow. The invention described herein is applicable to all multi-pass radiators which employ baffle plates to direct coolant flow.

It will also be appreciated that the use of the special gasket of this invention not only provides an effective baffle seal, it eliminates the need for RTV sealants and also eliminates the tedious and time consuming operation required in repairing multi-pass radiators.

What is claimed is:

1. A gasket for sealing a baffle plate positioned between opposite walls of the top or bottom tank of a multi-pass radiator having a radiator core, said baffle plate being the principal means for directing coolant through said core, and wherein an elongated channel member is secured to an end of said core and facing into one of said tanks, said channel member being adapted to receive a portion of said baffle plate, said gasket comprising an elongated, center section adapted to be received in said channel member and having generally flattened end sections integral with said center section and being adapted to be received in the flange area of said tank, said center section having an elongated slot running the length of said center section and extending into the interior of said center section to receive a free edge and portion of said baffle plate.

2. The gasket of claim 1 which is deformable and wherein the interior of said center section is hollow, is generally tubular in shape and extends the length of said baffle plate.

3. The gasket of claim 2 wherein said channel is generally V-shaped.

4. The gasket of claim 1 wherein said channel is generally U-shaped.

* * * * *